US012397216B2

(12) United States Patent
Chan

(10) Patent No.: US 12,397,216 B2
(45) Date of Patent: Aug. 26, 2025

(54) BASKETBALL TRAINING APPARATUS

(71) Applicant: Michael Chan, Winnipeg (CA)

(72) Inventor: Michael Chan, Winnipeg (CA)

( * ) Notice: Subject to any disclaimer, the term of this patent is extended or adjusted under 35 U.S.C. 154(b) by 387 days.

(21) Appl. No.: 17/866,745

(22) Filed: Jul. 18, 2022

(65) Prior Publication Data

US 2023/0059591 A1 Feb. 23, 2023

Related U.S. Application Data

(60) Provisional application No. 63/234,023, filed on Aug. 17, 2021.

(51) Int. Cl.
*A63B 69/00* (2006.01)
*A63B 63/08* (2006.01)

(52) U.S. Cl.
CPC ..... *A63B 69/0071* (2013.01); *A63B 63/083* (2013.01); *A63B 2243/0037* (2013.01)

(58) Field of Classification Search
CPC ..... A63B 69/0071; A63B 2243/0037
USPC ..... 473/447
See application file for complete search history.

(56) References Cited

U.S. PATENT DOCUMENTS 3,588,103 A * 6/1971 Fuller ..... A63B 63/083 473/470
3,598,407 A * 8/1971 Sorensen ..... A63B 63/083 473/482
3,614,099 A * 10/1971 Sarno ..... A63B 63/083 473/482
3,880,392 A * 4/1975 Duganich ..... A63B 63/083 473/482
4,239,214 A * 12/1980 Brenner ..... A63B 63/083 273/342
5,310,176 A * 5/1994 Berg ..... A63B 63/083 473/433
5,330,175 A * 7/1994 Kim ..... A63B 24/0021 273/402
5,547,185 A * 8/1996 Wagner ..... A63B 63/083 473/483
5,570,880 A * 11/1996 Nordgran ..... A63B 63/083 473/481
9,095,755 B1 * 8/2015 Hill ..... A63B 69/0071
2011/0105250 A1 * 5/2011 Tien ..... A63B 63/083 473/433

* cited by examiner

*Primary Examiner* — Mitra Aryanpour
(74) *Attorney, Agent, or Firm* — Ryan W. Dupuis; Michael R. Williams; Ade & Company Inc.

(57) ABSTRACT

A basketball training apparatus has a basketball hoop with a circular rim and a backboard adjacent to the hoop adjacent to a playing surface. A backboard frame assembly supports the backboard relative to the playing surface to be movable between a plurality of different working positions, in which each different working position corresponds to a different angular orientation of the backboard about the upright hoop axis. By effectively rotating the basketball net about the hoop axis, all the shooting positions of the half court can be simulated while the player remains in one position. This allows for the amount of space required to practice shooting at various points of a court to be done in a much more confined space.

20 Claims, 6 Drawing Sheets

BASKETBALL TRAINING APPARATUS

This application claims the benefit under 35 U.S.C. 119(e) of U.S. provisional application Ser. No. 63/234,023, filed Aug. 17, 2021.

FIELD OF THE INVENTION

The present invention relates to a basketball training apparatus including a hoop and a backboard for use in the sport of basketball, and more particularly, the present invention relates to a basketball training apparatus including a backboard and/or hoop which is adjustable between a plurality of different angular orientations.

BACKGROUND

The traditional basketball court is comprised of two symmetrical half courts. Each half court provides a player with various angles to the rim in which to score. The traditional half court dimensions are approximately 47'×50' totaling approximately 2350 sqft. When training, it is desirable for a player to be able to practice shooting from various angles to the basketball net, but this requires a large amount of practice space, even if only a half court is used for training purposes.

Furthermore, on a traditional basketball court, the player must move around the court to practice shooting the basketball at different angles to the backboard and hoop.

SUMMARY OF THE INVENTION

According to one aspect of the invention there is provided a basketball training apparatus for use with a playing surface and a basketball, the apparatus comprising:

- a hoop having a circular rim extending about an upright hoop axis, the circular rim being sized to allow passage of the basketball therethrough;
- a backboard supported adjacent to the hoop so as to be oriented parallel to the hoop axis;
- a supporting frame arranged to be supported in fixed relation to the playing surface; and
- a backboard frame assembly supporting the backboard on the supporting frame to be movable relative to the supporting frame between a plurality of different working positions;
- the backboard being parallel to the upright hoop axis in operative relationship with the hoop in each of the working positions;
- each different working position corresponding to a different angular orientation of the backboard relative to the supporting frame about the upright hoop axis.

With a rotating basketball net, all the positions of the half court can be simulated while the player remains in one position. This allows for the amount of space required to practice shooting at various points of a court to be done in a much more confined space. A motor can be provided which rotates in set increments so as to provide full coverage of the various conditions found on a half court. In this manner, when rotating the basketball net, various different shooting angles relative to the hoop and backboard can be achieved while the player remains stationary.

While the invention can be implemented in various residential and commercial settings, the application would be to allows for the densification of basketball practice facilities. Thereby allowing for increased training facilities within a smaller footprint. Applications in dense urban environments would provide the opportunity for those who aren't playing multi-player games to work on their basketball skillset without taking over an entire half court.

Modifications of the court lines to simulate the look and feel of the court would preferably form part of the experience of a half court simulation.

The backboard may be movable about the upright hoop axis through a range of at least 170 degrees, and more preferably through a range of 180 degrees or more.

When the working positions are defined at circumferentially spaced apart locations from one another, the apparatus may further comprise a control assembly arranged to selectively fix the backboard assembly immovably at any one of the working positions. The working positions may be evenly spaced apart from one another in a circumferential direction about the hoop axis. The number of the working positions may be greater than 5, and more preferably is greater than 10.

The apparatus preferably further includes a motor operatively connected between the backboard frame assembly and the supporting frame so as to be arranged to drive displacement of the backboard between the different working positions.

When the supporting frame includes an overhead portion arranged to be supported spaced above the hoop, the backboard frame assembly preferably extends downwardly from the supporting frame to support the backboard thereon at a bottom end of the supporting frame.

The backboard frame assembly is preferably supported for rotating movement about the upright hoop axis on the overhead portion of the supporting frame. In the illustrated embodiment, the backboard frame assembly comprises: (i) an arcuate frame portion having a center of curvature situated on the hoop axis and (ii) a depending frame portion extending downwardly from the arcuate frame portion to support the backboard thereon, in which the arcuate frame portion is circumferentially slidable relative to the supporting frame as the backboard is displaced between the different working positions.

When a rack of gear teeth is supported on the arcuate frame portion, preferably at least one drive gear is rotatably supported on the supporting frame in meshing engagement with the rack of gear teeth to drive displacement of the backboard between the different working positions. The at least one drive gear may comprise a spur gear, but more preferably comprises a worm gear.

The arcuate frame portion may be an annular ring surrounding the hoop axis. Preferably a diameter of the annular ring is greater than a lateral width of the backboard.

Preferably the hoop is supported on the backboard frame assembly so as to be movable with the backboard between the different working positions.

The apparatus may further comprise (i) a projector arranged to project basketball court lines onto a playing surface in proximity to the hoop and (ii) a controller arranged to change an angular orientation of the projected basketball court lines together with the backboard between the different working positions.

The playing surface is preferably elongated so as to define a shooting lane extending in a longitudinal direction between opposing ends, in which the basketball training apparatus is supported at one of the opposing ends. In this instance, the working positions include a neutral position in which the backboard is oriented perpendicularly to the longitudinal direction of the shooting lane. Preferably, the backboard is moveable in either one of two opposing directions from the neutral position towards the other ones of the working positions. Preferably, the backboard is movable from the neutral position in each direction through a range of 90 degrees about the hoop axis.

A facility may be provided including a plurality of playing surfaces may be provided, each defining a respective shooting lane and locating a respective basketball training apparatus at one of the opposing ends thereof. In this instance, the shooting lanes may be positioned parallel and adjacent to one another, in which each adjacent pair of the shooting lanes being separated by a longitudinally extending partition wall.

BRIEF DESCRIPTION OF THE DRAWINGS

Some embodiments of the invention will now be described in conjunction with the accompanying drawings in which.

In the drawings like characters of reference indicate corresponding parts in the different figures.

DETAILED DESCRIPTION

Figure 1:
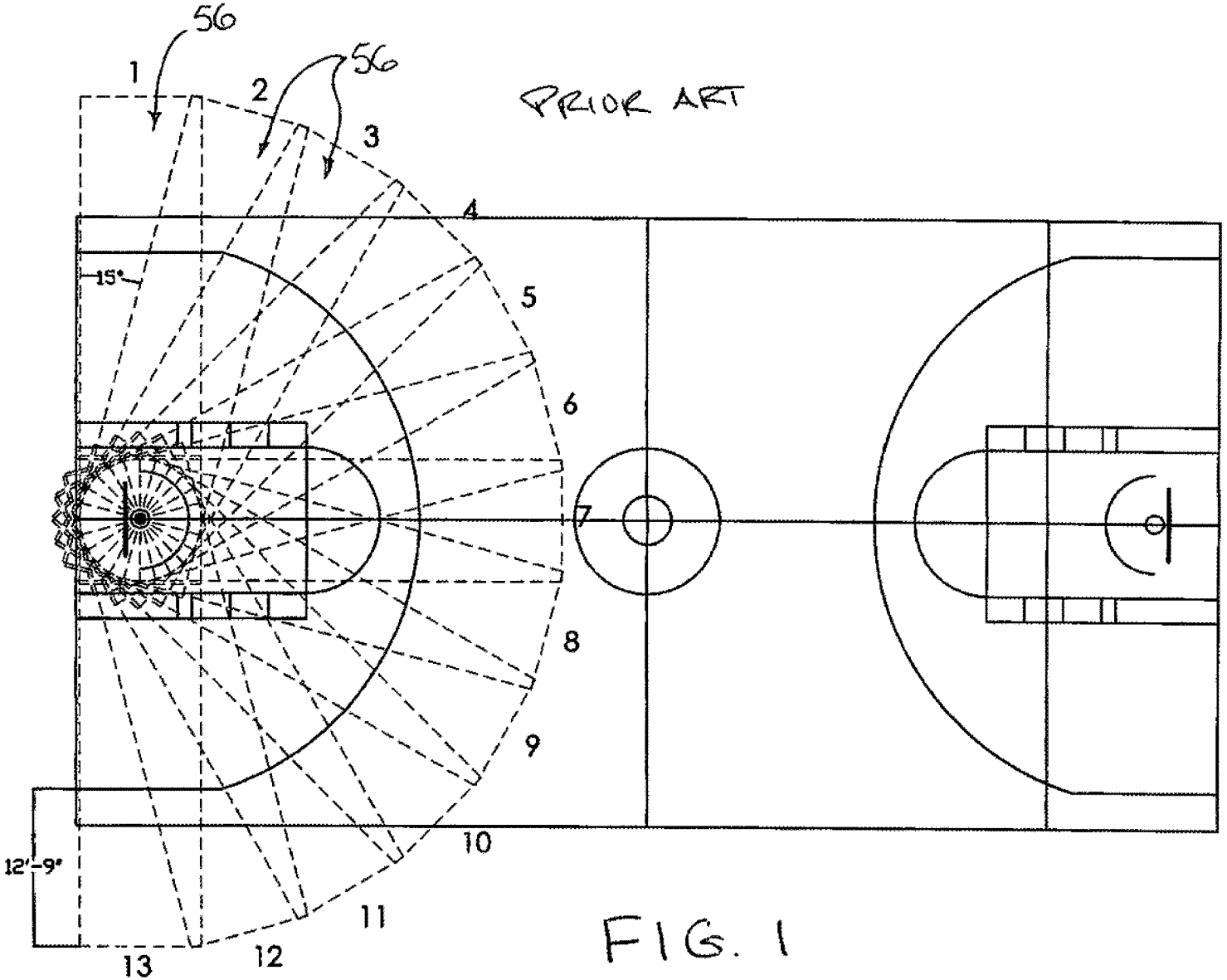
FIG. 1 is plan view of a conventional basketball court comprised of two half courts in which many different shooting lanes at different angular orientations are schematically represented on one of the half courts.

Referring to the accompanying figures there is illustrated a basketball training apparatus generally indicated by reference numeral 10. While various illustrated embodiments are shown in the accompanying figures, the features in common among the various illustrated embodiments will first be described.

The apparatus 10 defines a basketball net including a hoop 12 and a backboard 14 arranged relative to one another in the manner of a conventional basketball net of the type used in the game of basketball. The apparatus 10 is intended to be used with a playing surface 16 such that the basketball hoop is supported space above the playing surface by a distance corresponding to the traditional height of a basketball net in the game of basketball. The playing surface 16 is a horizontal rigid surface upon which a basketball can be dribbled in the usual manner.

According to the illustrated embodiments, a plurality of apparatuses 10 can be supported within a common building to define a common training facility that can accommodate a plurality of different players each training on their own respective training apparatus 10. In this instance, each apparatus 10 is associated with its own respective playing surface in which the playing surface is elongate in a longitudinal direction between two opposing ends 18 to define a shooting lane extending in a longitudinal direction between the opposing ends.

The playing surfaces are located in proximity to one another such that the defined shooting lanes are parallel and directly adjacent to one another in a row of adjacent shooting lanes. The playing surfaces of each adjacent pair of shooting lanes are separated by a partition wall 20 extending upward from the playing surfaces. In this manner each shooting lane is defined between two longitudinally extending partition walls 20 which are parallel and spaced apart from one another by the width of the shooting lane. A user can position themselves at any location between the opposing ends 18 of the shooting lane for shooting a basketball towards the hoop 12 of the apparatus 10 at one end of the shooting lane.

The basketball training apparatus 10 according to the present invention generally includes: (i) a supporting frame 22, (ii) a backboard frame assembly 24 movably supported on the supporting frame 22 for movement between a plurality of different working positions of the apparatus 10, (iii) the backboard 14 supported on the backboard frame assembly to be movable with the backboard frame assembly between the different working positions of the apparatus 10, and (iv) the hoop 12 which is supported in operative relation to the backboard in each of the working positions while defining a hoop axis about which the backboard is angularly displaced between the different working positions. More particularly, each different working position of the backboard corresponds to a different angular orientation of the backboard relative to the supporting frame about the upright hoop axis of the hoop. A neutral position of the apparatus is defined when the backboard is oriented perpendicularly to the longitudinal direction of the shooting lane.

The supporting frame 22 is intended to be mounted in fixed and immovable relationship to the playing surface. More particularly, the supporting frame 22 includes an overhead portion 26 which is supported spaced above the playing surface by being supported on an upright frame portion or by being supported on part of the main frame of the building for example. In the latter instance, the supporting frame may be fixed between rafters or other suitably rigid and structurally supporting structures of the building frame.

In the illustrated embodiment, the supporting frame includes two beams 28 which are mounted parallel and spaced apart from one another to extend between corresponding frame members of the building frame. A pair of crossbars 30 extend between the two beams in fixed relation therewith at parallel and spaced apart positions from one another such that the beams 28 and the crossbars 30 define a generally square perimeter surrounding a central opening of the supporting frame. Additional corner braces 32 may span across each corner of the supporting frame to reinforce the junction of the crossbars with the beams respectively.

The backboard frame assembly 24 generally includes an arcuate frame portion 34 extending along an arc having a centre of curvature at the hoop axis to define a full annular ring according to the illustrated embodiment. The arcuate frame portion 34 can be supported above the overhead portion 26 of the supporting frame. The annular ring of the arcuate frame portion 34 includes a rack of gear teeth 36 formed at least partway about the outer circumference thereof. The internal diameter of the arcuate frame portion 34 is greater than a horizontal width of the backboard 24. In this manner the annular ring provides a broad stable structure from which the hoop and backboard can be suspended in use.

The arcuate frame portion 34 is supported on the top side of the overhead portion of the supporting frame by a plurality of bushings or rollers on the supporting frame such that the arcuate frame portion 34 is rotatable relative to the supporting frame about the hoop axis.

In the neutral position of the backboard frame assembly, two first frame member 38 extend across the annular ring of the arcuate frame portion at parallel and spaced apart positions in perpendicular relation to the longitudinal direction of the shooting lane of the corresponding playing surface such that each first frame member 38 forms a chord relative to the annular ring. One or more transverse frame members 40 extend perpendicularly across the first frame members 38 to be supported at opposing ends at different locations along the annular ring of the arcuate frame portion 34 such that the one or more transverse frame members 40 also define chords relative to the annular ring.

The backboard frame assembly further includes a depending frame portion 42 extending downwardly from the arcuate frame portion 34 through the central opening in the overhead portion of the supporting frame. The depending frame portion 42 includes one or more legs 44 extending vertically downward at spaced apart positions from the frame members 38 or 40 of the arcuate frame portion 34. The one or more legs 44 support the backboard 14 at a front side thereof. Each leg 44 is further supported by an angled brace 46 extending upward and rearward from the rear side of the leg 44 to a respective top end mounted at a location spaced the attachment of the leg 44 on the arcuate frame portion to rigidly support the backboard on the one or more legs 44 in fixed and immovable relationship relative to the arcuate frame portion 34 of the backboard frame assembly.

The backboard 14 is a flat, rectangular, rigid body having a vertical face at the front side thereof to provide a rebounding surface against which a basketball can be redirected when thrown towards the hoop in the usual manner of the game of basketball.

The hoop 12 defines a circular rim 48 sized to correspond to the conventional rim of a basketball net in the game of basketball such that a basketball can be received through the circular rim in the usual manner. The circular rim 48 has a central axis that defines the hoop axis about which the backboard is rotated between the different working positions as described herein. An additional bracket 50 extends between the rim and the backboard to support the rim 48 at a location spaced slightly forwardly of the front face of the backboard 14 by the usual amount corresponding to a conventional basketball net used in the game of basketball.

The apparatus 10 further includes two motors 52 supported on the overhead portion 26 of the supporting frame 22 in which the motors drive rotation of one or more drive gears 54 mounted in meshing relationship with the rack of gear teeth 36 on the outer circumference of the annular ring of the arcuate frame portion 34 such that the motors drive rotation of the one or more drive gears 54 and in turn drive rotation of the arcuate frame portion 34 of the backboard frame assembly relative to the supporting frame about the hoop axis of the hoop 12.

The motors 52 preferably comprise stepper motors which can drive rotation of the arcuate frame portion 34 and the backboard supported thereon in controlled amounts corresponding to controlled increments of displacement in the circumferential direction about the hoop axis between the different working positions. In this instance, each working position corresponds to a respective angular orientation of the backboard about the hoop axis that the backboard can be positioned to under control of the stepper motor. The motors 52 may be arranged to operate together in the same direction at the same time to alternately drive rotation in the two opposing directions of rotation together. Alternatively, (i) a first one of the motors 52 may be responsible for driving rotation in a first direction while a second one of the motors 52 is disengaged, and (i) the second one of motors is responsible for driving rotation in the opposing second direction while the first one of the motors is disengaged. In the preferred embodiment, the motors 52 are suitably arranged to drive rotation of the backboard in either direction of rotation from the neutral position through a range of 90 degrees or more in each direction, while being configured to fix the orientation of the backboard at any selected one of the working positions. The working positions are located at evenly spaced intervals throughout the range of movement. For example, the motors may be arranged to position the backboard at any selected one of a plurality of 15 degree increments in either direction of rotation from the neutral position such that the backboard can be displaced through a range of 180 degrees or more overall.

In the preferred embodiment, the hoop is supported on the backboard frame assembly together with the backboard such that the hoop 12 and backboard 14 are movable together about the hoop axis while the hoop axis remains at a fixed location relative to the playing surface so as to remain substantially centred between the corresponding partition walls of the respective shooting lane. The hoop therefore remains in an operative relationship relative to the backboard in each working position of the apparatus. Furthermore, at each working position, the backboard is positioned at a different angular orientation about the hoop axis relative to the longitudinal direction of the shooting lane of the corresponding playing surface.

According to the present invention, the user can remain at a fixed location at one end of a corresponding shooting lane while the backboard moves between different working positions. This has the effect of simulating the player moving orientations about a basketball court relative to a conventional basketball net, but with reduced space requirements. When rotating the basketball net through a plurality of increments as described above, the apparatus 10 can simulate the positioning of a shooter at one end of the shooting lane relative to the basketball net for each of the different schematically represented shooting lanes 56 represented on a conventional basketball court according to FIG. 1.

To further simulate the position of a user on a basketball court, the apparatus 10 may further include a projector 58 supported by a suitable supporting frame in fixed relation to the building structure at a location spaced above the playing surface to generate a suitable projection directed downwardly onto the playing surface comprised of projected basketball court lines 60.

The projector 58 is controlled by a suitable controller 62 in the form of a computer system including a processor and a memory storing programming instructions thereon which are executable by the processor to execute the various functions described herein. The same controller 62 can communicate with a suitable remote controller 64 operated by the user and with the motors 52. The remote controller 64 generates command signals arranged to be received by the controller so that the controller can in turn generate suitable command signals for the motors 52 in response to the command signals received from the remote controller 64.

Each time the controller 62 directs the motors to reposition the backboard to a different working position, corresponding instructions are generated for the projector 58 such that the projected basketball court lines 60 at each working position correspond to the portion of the actual lines of a basketball court that would be intersected by the shooting lane 56 that is represented on the playing surface of the apparatus 10. Accordingly, when the backboard is rotated to a different working position, under control of the controller 62, the controller further directs the projector 58 to effectively rotate the projected basketball court lines by a corresponding amount about the same hoop axis.

Turning now to the first embodiment shown in FIGS. 3 through 8, the depending frame portion 42 of the backboard frame assembly in this instance includes two legs 44 extending vertically downward at spaced apart positions from a forwardmost one of frame members 38 of the arcuate frame portion 34. Two angled braces 46 extend upward and rearward from the rear side of the legs respectively to top ends of the braces 46 that are mounted at spaced apart positions on a rearmost one of the crossbars 38 of the arcuate frame portion to rigidly support the backboard on the legs 44 in fixed and immovable relationship relative to the arcuate frame portion 34 of the backboard frame assembly.

Also in the first embodiment, each drive motor 52 supports a respective drive gear 54 thereon in which the drive gear is a spur gear in meshing engagement with the gear teeth 36 on the arcuate frame portion 34 so that the two drive gears 54 are supported with the respective drive motors 52 at spaced apart positions on the rearmost beam 28 of the supporting frame.

Figure 3:
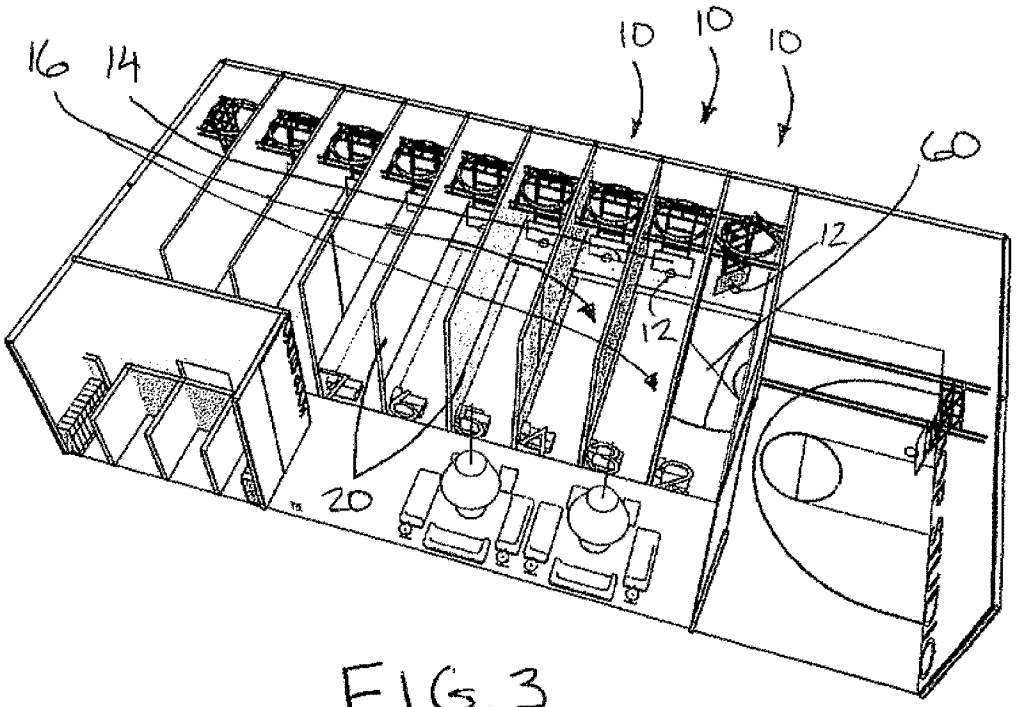
FIG. 3 is a perspective view of a facility incorporating a plurality of basketball training apparatuses according to a first embodiment of the present invention therein.
Figure 2:
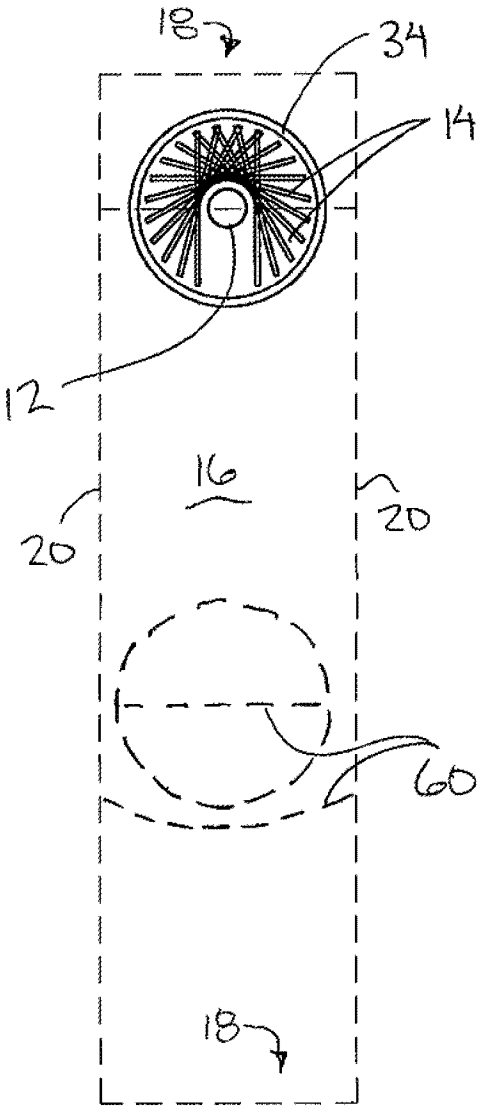
FIG. 2 is a schematic representation of a single shooting lane supporting the basketball training apparatus according to the present invention therein at a plurality of different orientations relative to the single shooting lane so as to simulate the different shooting lanes represented in FIG. 1.
Figure 5:
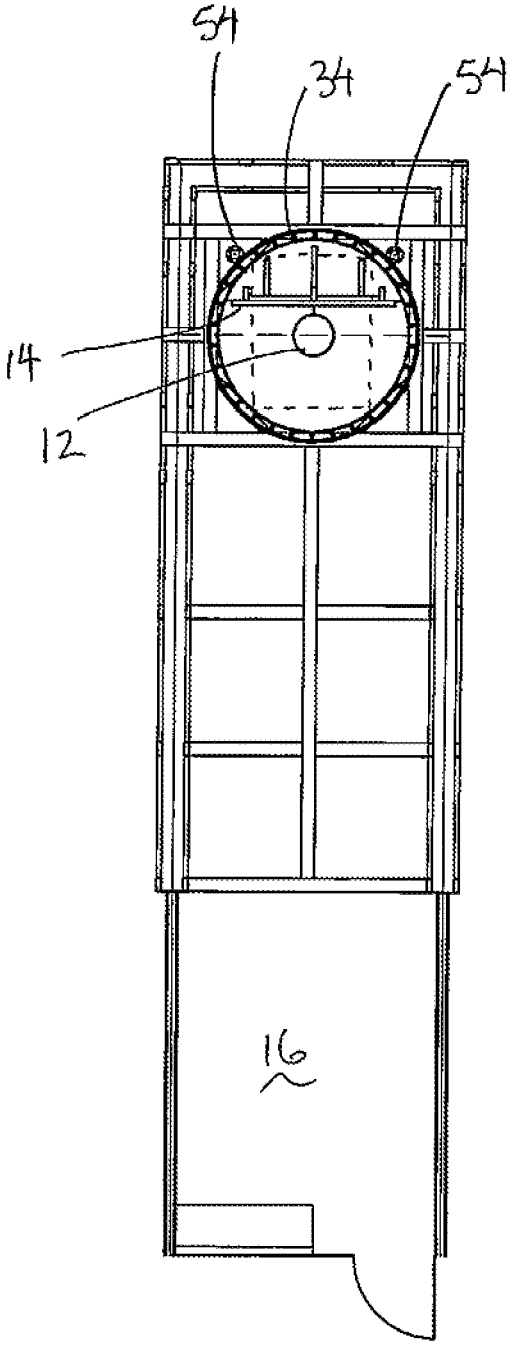
FIG. 5 is a top view of one shooting lane of the facility, in which the backboard and hoop are illustrated, according to the first embodiment of FIG. 3.
Figure 4:
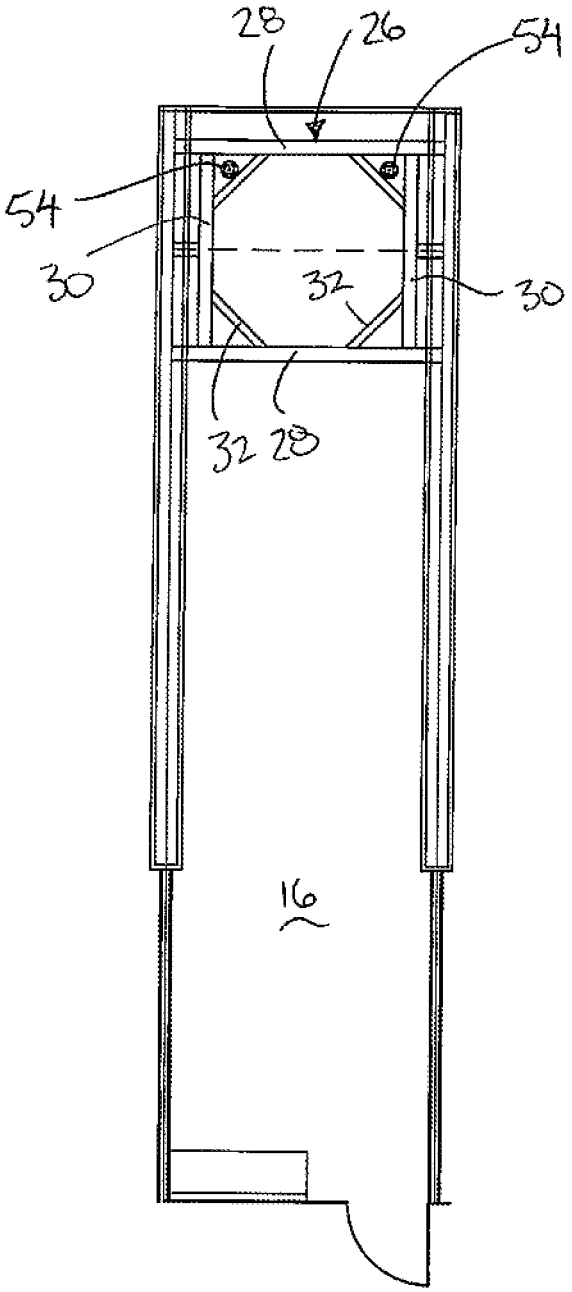
FIG. 4 is a top view of one shooting lane of the facility, with a portion of the basketball training apparatus according to the first embodiment of FIG. 3 shown removed for illustrative purposes.
Figure 7:
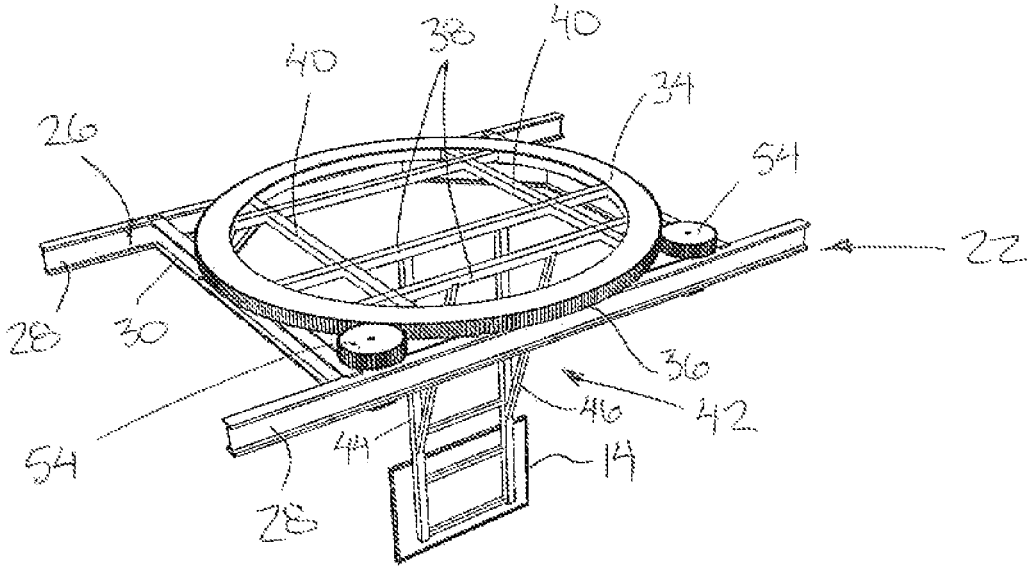
FIG. 7 is a perspective view of the basketball training apparatus from above, according to the first embodiment of FIG. 3.
Figure 6:
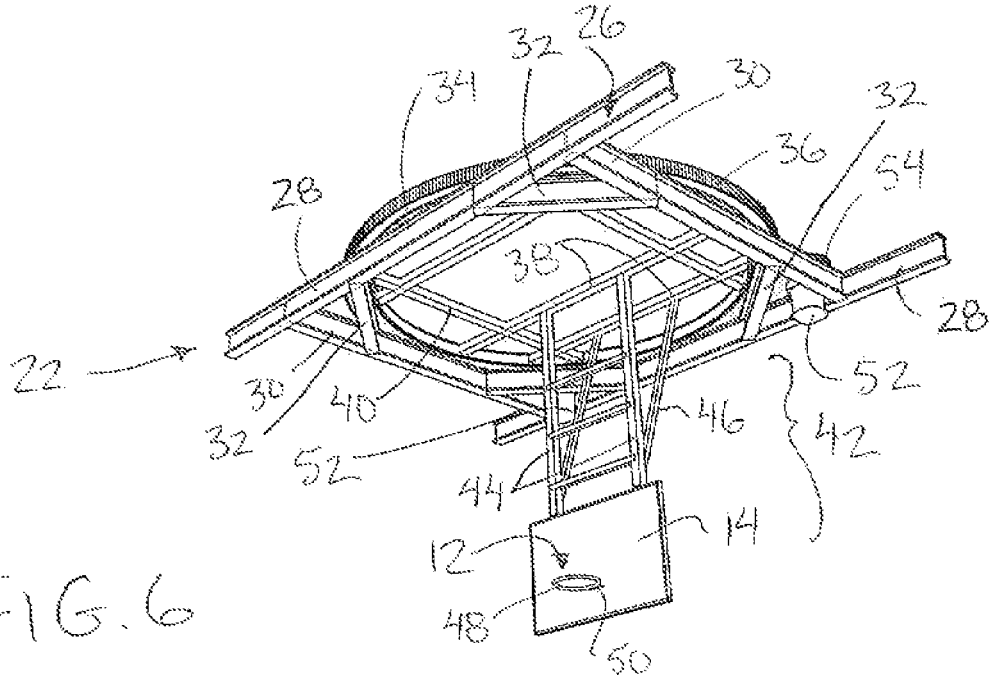
FIG. 6 is a perspective view of the basketball training apparatus from below, according to the first embodiment of FIG. 3.
Figure 8:
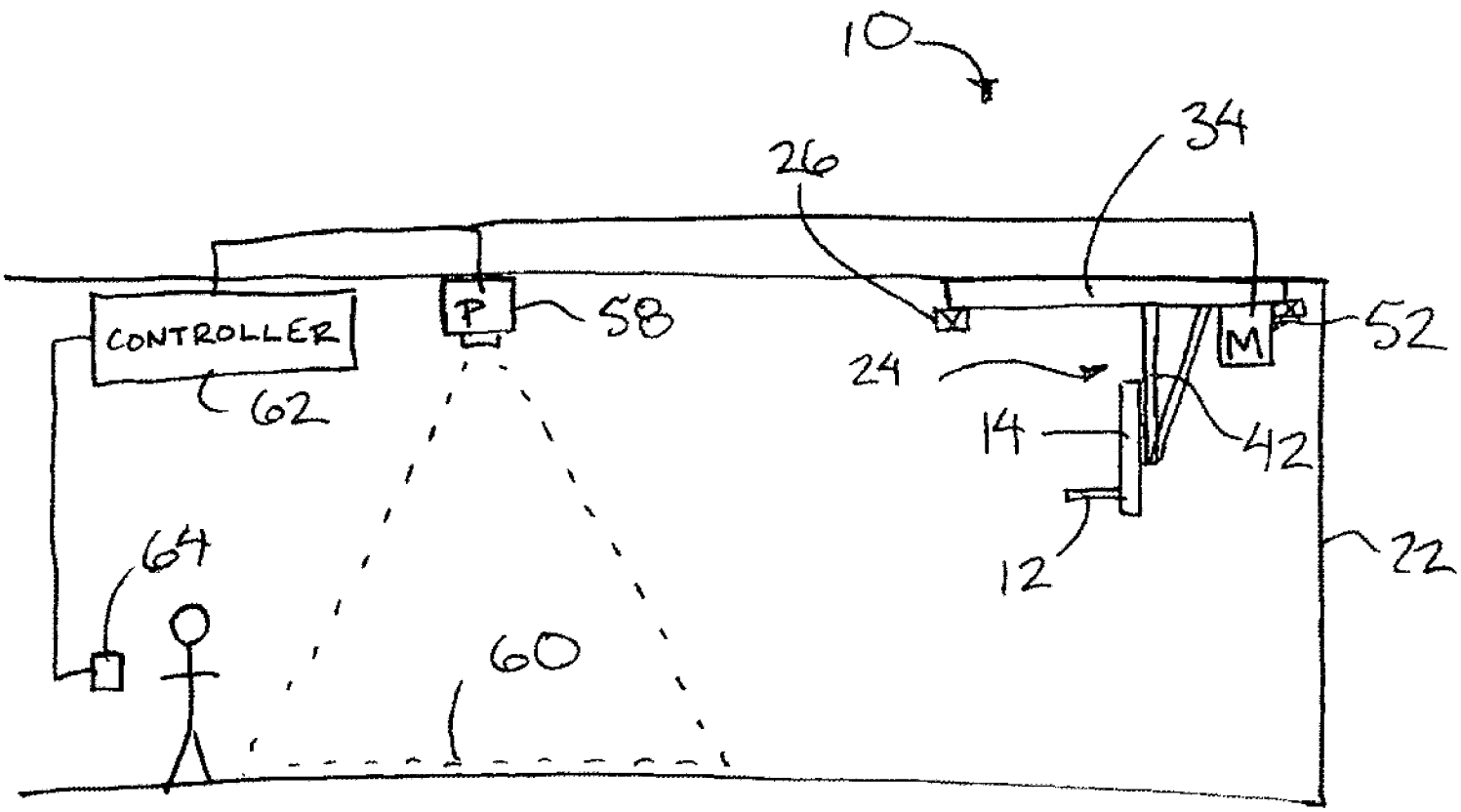
FIG. 8 is a schematic elevational view of one shooting lane of the facility, illustrating components of a control assembly for operating the basketball training apparatus, according to the first embodiment of FIG. 3.
Figure 9:
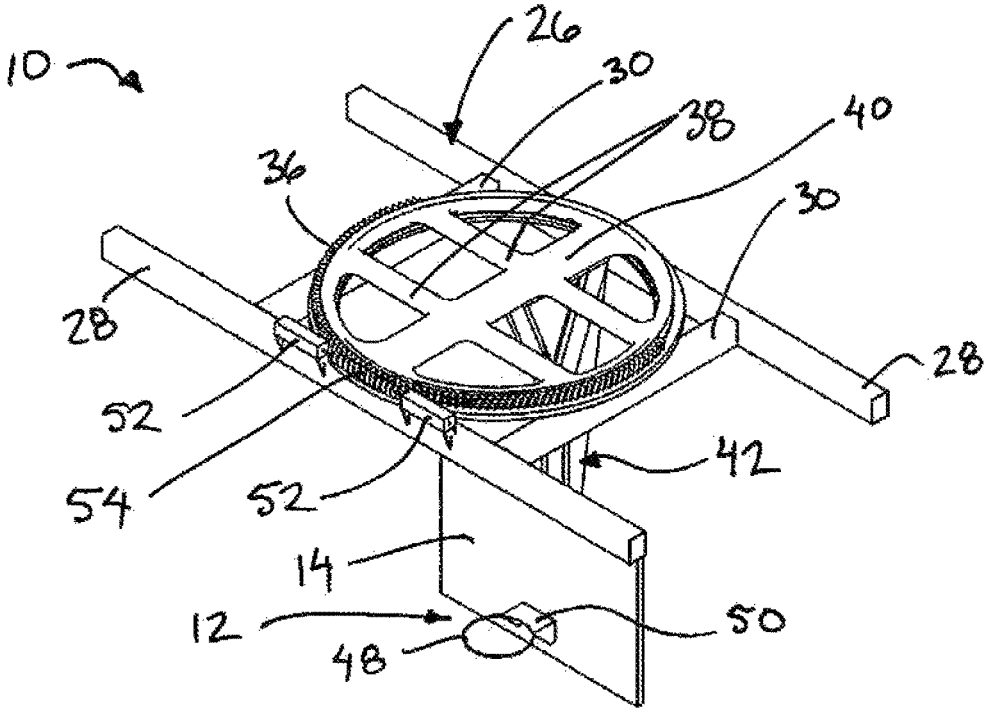
FIG. 9 is a perspective view of the basketball training apparatus from above, according to a second embodiment.
Figure 10:
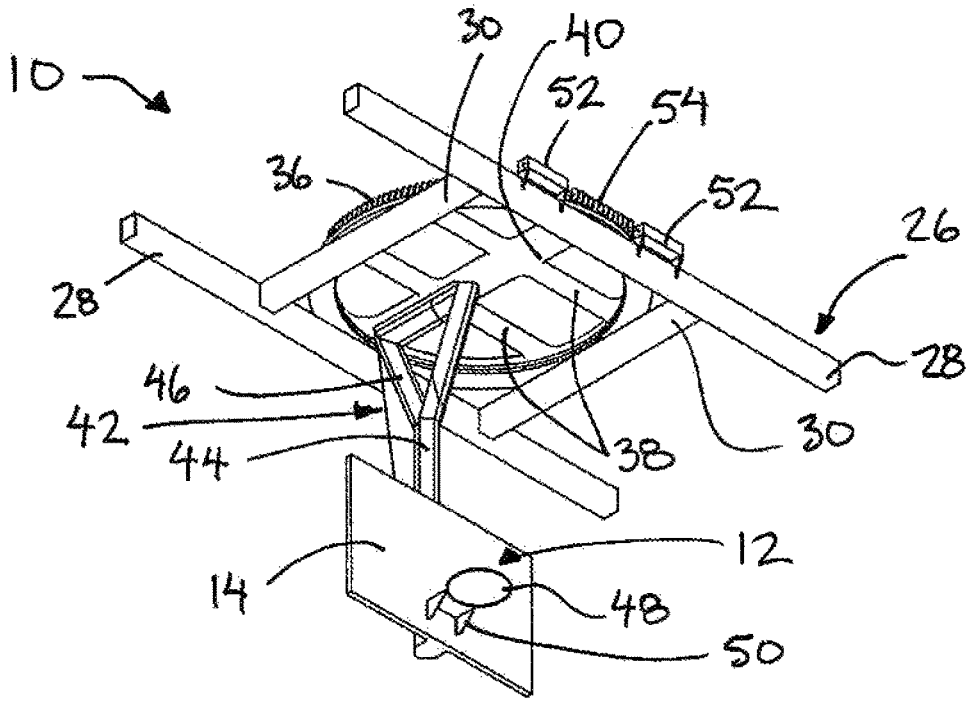
FIG. 10 is a perspective view of the basketball training apparatus from below, according to the second embodiment of FIG. 9.

Turning now to the second embodiment shown in FIGS. 9 and 10, the apparatus 10 in this instance is intended to be used within a facility according to FIGS. 3 and 8 in a manner which is identical to the first embodiment. The apparatus 10 according to the second embodiment differs from the previous embodiment in that there is provided a single transverse frame member 40 spanning across the arcuate frame portion 34 at a laterally centred location, in which the transverse frame member 40 is much larger in cross section and stronger compared to the first frame members 38 which provide support to the frame member 40. The frame member 40 provides support for a single leg 44 of the depending frame portion which extends downwardly and rearwardly from a central location on the frame member 40. The brace 46 extends upwardly and rearwardly from an intermediate location on the leg 44 for connection at the upper end of the brace 46 on the frame member 40 at a location spaced rearwardly of the mounting location of the leg 44.

The second embodiment also differs from the previous embodiment by (i) the placement of the drive motors 52 at spaced positions on the forwardmost beam 28 of the supporting frame, and (ii) the use of a drive gear 54 in the form of a worm gear mounted centrally between the drive motors 52 in meshing engagement with the gear teeth 36 on the arcuate frame portion 34. The drive motors 52 can cooperatively drive the single worm drive gear 54 if operated together in both directions of rotation. Alternatively, the single worm drive gear 54 can be driven by one of the motors 52 in one direction and by the other motor 52 in the opposing direction. The worm gear is useful to prevent backlash and more precisely locate the arcuate frame portion.

In any of the above embodiments, the gear teeth 36 can extend only about part of the circumference of the arcuate frame portion 34 to minimize weight. Use of a single worm drive gear 54 further reduces the overall operating length in the circumferential direction that is required of the rack of gear teeth 36.

Furthermore, in any of the above embodiments, the upper rotating mechanism such as: the arcuate frame portion 34, the frame members 38 and 40 extending across the arcuate frame member, the leg(s) 44 of the depending frame portion 42, and/or the brace(s) 46 of the depending frame portion can be made of layered composite material connected to the backboard supports to (i) reduce the suspended weight of rotating components carried on bearings on the supporting frame and (ii) minimize the amount of force required by the motors 52 to drive rotation of the rotating components between the different operating positions of the apparatus as a result of the reduced weight.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A basketball training apparatus for use with a playing surface and a basketball, the apparatus comprising:

a hoop having a circular rim extending about an upright hoop axis, the circular rim being sized to allow passage of the basketball therethrough;

a backboard supported adjacent to the hoop so as to be oriented parallel to the hoop axis;

a supporting frame arranged to be supported in fixed relation to the playing surface; and a backboard frame assembly supporting the backboard on the supporting frame to be movable relative to the supporting frame between a plurality of different working positions;

the backboard being parallel to the upright hoop axis in operative relationship with the hoop in each of the working positions; and each different working position defining a different angular orientation of the backboard relative to the supporting frame corresponding to a rotation of the backboard relative to the supporting frame about the upright hoop axis, such that the hoop axis remains at a fixed location relative to the playing surface as the backboard is displaced between the plurality of working positions.

2. The apparatus according to claim 1 wherein the backboard is rotatable about the upright hoop axis through a range of at least 170 degrees.

3. The apparatus according to claim 1 wherein the backboard is rotatable about the upright hoop axis through a range of 180 degrees or more.

4. The apparatus according to claim 1 wherein the working positions are defined at circumferentially spaced apart locations from one another about the hoop axis and wherein the apparatus further comprises a control assembly arranged to selectively fix the backboard assembly immovably at any one of the working positions.

5. The apparatus according to claim 4 wherein the working positions are evenly spaced apart from one another in a circumferential direction about the hoop axis.

6. The apparatus according to claim 4 wherein a number of the working positions is greater than 5.

7. The apparatus according to claim 4 wherein a number of the working positions is greater than 10.

8. The apparatus according to claim 1 further comprising a motor operatively connected between the backboard frame assembly and the supporting frame so as to be arranged to drive displacement of the backboard between the different working positions.

9. The apparatus according to claim 1 wherein the supporting frame includes an overhead portion arranged to be supported spaced above the hoop, the backboard frame assembly extending downwardly from the supporting frame to support the backboard thereon at a bottom end of the supporting frame.

10. A basketball training apparatus for use with a playing surface and a basketball, the apparatus comprising:

a hoop having a circular rim extending about an upright hoop axis, the circular rim being sized to allow passage of the basketball therethrough;

a backboard supported adjacent to the hoop so as to be oriented parallel to the hoop axis:

a supporting frame arranged to be supported in fixed relation to the playing surface; and a backboard frame assembly supporting the backboard on the supporting frame to be movable relative to the supporting frame between a plurality of different working positions;

wherein the backboard is parallel to the upright hoop axis in operative relationship with the hoop in each of the working positions;

wherein each different working position corresponds to a different angular orientation of the backboard relative to the supporting frame about the upright hoop axis;

wherein the supporting frame includes an overhead portion arranged to be supported spaced above the hoop, the backboard frame assembly extending downwardly from the supporting frame to support the backboard thereon at a bottom end of the supporting frame; and wherein the backboard frame assembly is supported for rotating movement about the upright hoop axis on the overhead portion of the supporting frame.

11. A basketball training apparatus for use with a playing surface and a basketball, the apparatus comprising:

a hoop having a circular rim extending about an upright hoop axis, the circular rim being sized to allow passage of the basketball therethrough;

a backboard supported adjacent to the hoop so as to be oriented parallel to the hoop axis;

a supporting frame arranged to be supported in fixed relation to the playing surface; and a backboard frame assembly supporting the backboard on the supporting frame to be movable relative to the supporting frame between a plurality of different working positions;

wherein the backboard is parallel to the upright hoop axis in operative relationship with the hoop in each of the working positions;

wherein each different working position corresponds to a different angular orientation of the backboard relative to the supporting frame about the upright hoop axis;

wherein the supporting frame includes an overhead portion arranged to be supported spaced above the hoop, the backboard frame assembly extending downwardly from the supporting frame to support the backboard thereon at a bottom end of the supporting frame; and wherein the backboard frame assembly comprises:

an arcuate frame portion having a center of curvature situated on the hoop axis; and a depending frame portion extending downwardly from the arcuate frame portion to support the backboard thereon;

the arcuate frame portion being circumferentially slidable relative to the supporting frame as the backboard is displaced between the different working positions.

12. The apparatus according to claim 11 further comprising a rack of gear teeth supported on the arcuate frame portion and at least one drive gear rotatably supported on the supporting frame in meshing engagement with the rack of gear teeth to drive displacement of the backboard between the different working positions, said at least one drive gear comprising a worm gear.

13. The apparatus according to claim 11 wherein the arcuate frame portion is an annular ring surrounding the hoop axis.

14. The apparatus according to claim 13 wherein a diameter of the annular ring is greater than a lateral width of the backboard.

15. The apparatus according to claim 1 wherein the hoop is supported on the backboard frame assembly so as to be movable with the backboard between the different working positions.

16. The apparatus according to claim 1, further comprising a projector arranged to project basketball court lines onto a playing surface in proximity to the hoop and a controller arranged to change an angular orientation of the projected basketball court lines together with the backboard between the different working positions.

17. The apparatus according to claim 1 in combination with the playing surface, the playing surface being elongated so as to define a shooting lane extending in a longitudinal direction between opposing ends, the basketball training apparatus being supported at one of the opposing ends.

18. The apparatus according to claim 17 wherein the working positions include a neutral position in which the backboard is oriented perpendicularly to the longitudinal direction of the shooting lane, the backboard being moveable in either one of two opposing directions from the neutral position towards the other ones of the working positions.

19. The apparatus according to claim 18 wherein the backboard is movable from the neutral position in each direction through a range of 90 degrees about the hoop axis.

20. The apparatus according to claim 17 in combination with a plurality of playing surfaces each defining a respective shooting lane and locating a basketball training apparatus at one of the opposing ends thereof, the shooting lanes being positioned parallel and adjacent to one another, and each adjacent pair of the shooting lanes being separated by a longitudinally extending partition wall.

* * * * *